US006367523B1

(12) United States Patent
Hu

(10) Patent No.: US 6,367,523 B1
(45) Date of Patent: Apr. 9, 2002

(54) CUTTING TOOL DEVICE FOR WOOD PLANING MACHINE

(76) Inventor: Teng-Fu Hu, No. 15, Kuang-Ming 5th Lane, Nan Dist., Taichung City (TW)

( * ) Notice: Subject to any disclaimer, the term of this patent is extended or adjusted under 35 U.S.C. 154(b) by 0 days.

(21) Appl. No.: 09/874,336

(22) Filed: Jun. 6, 2001

(30) Foreign Application Priority Data

Apr. 17, 2001 (TW) ..... 090206008

(51) Int. Cl.[7] ..... B27C 5/00

(52) U.S. Cl. ..... 144/230; 144/218; 144/221; 144/241; 407/41

(58) Field of Search ..... 144/114.1, 117.1, 144/129, 130, 218, 230, 229, 241, 221; 407/40, 41, 49, 87, 108

(56) References Cited

U.S. PATENT DOCUMENTS 4,830,073 A * 5/1989 De Abreu ..... 144/241
6,092,571 A * 7/2000 Liao ..... 144/130
6,095,211 A * 8/2000 Chiang ..... 144/230

* cited by examiner

*Primary Examiner*—W. Donald Bray
(74) *Attorney, Agent, or Firm*—Morgan, Lewis & Bockius LLP

(57) ABSTRACT

A cutting tool device for a wood planing machine includes a driving shaft having a cylindrical portion and a plurality of insert receiving channels. Each of the channels includes a knife seat wall surface and an abutment wall surface, which confine an accommodating cavity therebetween. The knife seat wall surface has left and right end edges respectively having left and right secant points at a respective junction with an outer wall surface of the cylindrical portion. The left secant point lags behind the right secant point in a counter-clockwise operating direction. A planing knife is disposed to abut against the knife seat wall surface. A tightening insert member is inserted into the accommodating cavity, and has front and rear wall surfaces respectively abutting against the planing knife and the abutment wall surface to thereby clamp the planing knife firmly in the respective channel.

6 Claims, 8 Drawing Sheets

CUTTING TOOL DEVICE FOR WOOD PLANING MACHINE

CROSS-REFERENCE TO RELATED APPLICATION

This application claims priority of Taiwan Patent Application No. 90206008, filed on Apr. 17, 2001.

BACKGROUND OF THE INVENTION

1. Field of the Invention

The invention relates to a cutting tool device for a wood planing machine, more particularly to a cutting tool device with planing knives that are firmly positioned thereon. Each of the planing knives has a cutting edge that is brought to be in point contact with the workpiece during operation.

2. Description of the Related Art

FIG. 1 shows a conventional cutting tool device for a wood planing machine. As shown, the conventional cutting tool device includes a knife driving shaft 1, a plurality of planing knives 2, and a plurality of tightening members 3.

The knife driving shaft 1 has an outer circumferential wall surface 101, and is provided with a plurality of insert grooves 102 angularly displaced from each other in the circumferential wall surface 101, and a plurality of shavings grooves 103 disposed proximate to a respective one of the insert grooves 102.

Each of the planing knives 2 has a cutting edge 201 projecting from the outer circumferential wall surface 101, and a blade portion 202 disposed in a respective one of the insert grooves 102.

Each of the tightening members 3 includes a threaded rod portion 301 that extends into a respective one of the insert grooves 102, and a head portion 302 for abutting against a respective one of the planing knives 2 in the respective one of the insert grooves 102.

During assembly, the planing knives 2 are respectively inserted into the insert grooves 102. Then, the tightening members 3 are respectively extended into the insert grooves 102 such that the head portions 302 thereof abut against the respective planing knife 2 to thereby position the planing knives 2 on the knife driving shaft 1.

Although the planing knives 2 of the conventional cutting tool device are positioned on the knife driving shaft 1, during planing of a workpiece, the planing knives 2, which are uprightly disposed in the insert grooves 102, may slip out from their respective insert groove 102. Besides, as the cutting edge 201 of each planing knife 2 is in linear contact with the workpiece, there exists an undesirably large frictional resistance to the cutting edge, which results in a heavy workload on an output shaft of a motor (not shown) and increased power consumption.

SUMMARY OF THE INVENTION

Therefore, the main object of the present invention is to provide a cutting tool device with planing knives that are firmly positioned thereon. Each of the planing knives has a cutting edge that is brought to be in point contact with the workpiece during operation.

Accordingly, a cutting tool device of the present invention is adapted for use in a wood planing machine, and includes an elongate knife driving shaft, a plurality of elongate planing knives, a plurality of tightening insert members, and a plurality of tightening members. The knife driving shaft is adapted to rotate in a counterclockwise operating direction about an axis, and includes left and right annular end wall surfaces opposite to each other in an axial direction parallel to the axis, and a cylindrical portion extending therebetween. The cylindrical portion has an outer circumferential wall surface surrounding the axis, and a plurality of insert receiving channels disposed to be angularly displaced from one another about the axis. Each of the insert receiving channels includes a knife seat wall surface and an abutment wall surface. The knife seat wall surface extends from the outer circumferential wall surface inwards and in the axial direction to form left and right end edges that join and intersect the left and right annular end wall surfaces, respectively. The left and right end edges respectively have left and right secant points at a respective junction with the outer circumferential wall surface. Each of the left and right end edges is configured such that an acute angle is formed between a respective one of the left and right end edges and a tangent line extending from a respective one of the left and right secant points rearwards in terms of the operating direction, and such that the left secant point lags behind the right secant point in the operating direction. The abutment wall surface extends from the outer circumferential wall surface inwards and in the axial direction to form left and right lateral edges that join the left and right annular end wall surfaces, respectively. The left and right lateral edges are configured to be spaced apart from the left and right end edges, respectively, so as to confine an accommodating cavity therebetween. The accommodating cavity extends radially and outwardly to communicate with the outer circumferential wall surface. Each of the planing knives includes front and rear major blade surfaces opposite to each other, and an elongate cutting edge which has left and right edge ends opposite to each other and joining the front and rear major blade surfaces. Each of the planing knives is disposed in a respective one of the insert receiving channels such that the front major blade surface is disposed to abut against the knife seat wall surface, such that the cutting edge is disposed to extend beyond the outer circumferential wall surface, such that the left and right edge ends are disposed to be adjacent to the left and right secant points, respectively, and such that the rear major blade surface faces towards the abutment wall surface. Each of the tightening insert members has front and rear mating wall surfaces opposite to each other in the operating direction, and is disposed to be removably inserted into the accommodating cavity to abut against the rear major blade surface of one of the planing knives and the abutment wall surface of one of the insert receiving channels, respectively. The tightening insert members are configured such that when a respective one of the tightening insert members is being inserted into the accommodating cavity radially and inwardly, a friction force generated as a result of sliding movement of the front mating wall surface along the rear major blade surface will impart a force component to the rear mating wall surface to cause the rear mating wall surface to abut against the abutment wall surface, thereby clamping the respective one of the planing knives between the front mating wall surface and the knife seat wall surface. The tightening members are disposed to threadedly secure the tightening insert members to the cylindrical portion respectively so as to ensure immobility of the planing knives.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
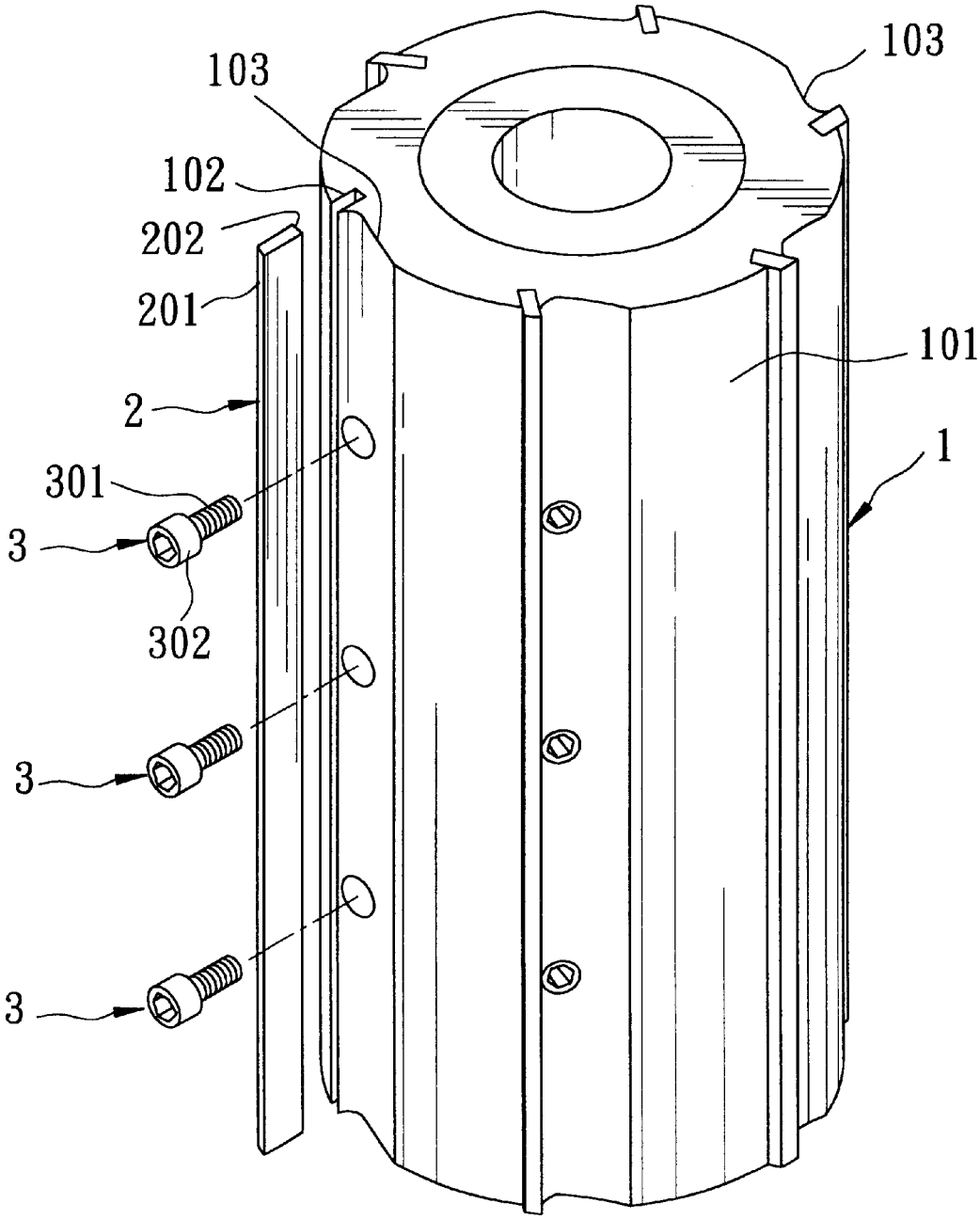
FIG. 1 PRIOR ART
FIG. 1 is a partly exploded perspective view of a conventional cutting tool device.
Figure 2:
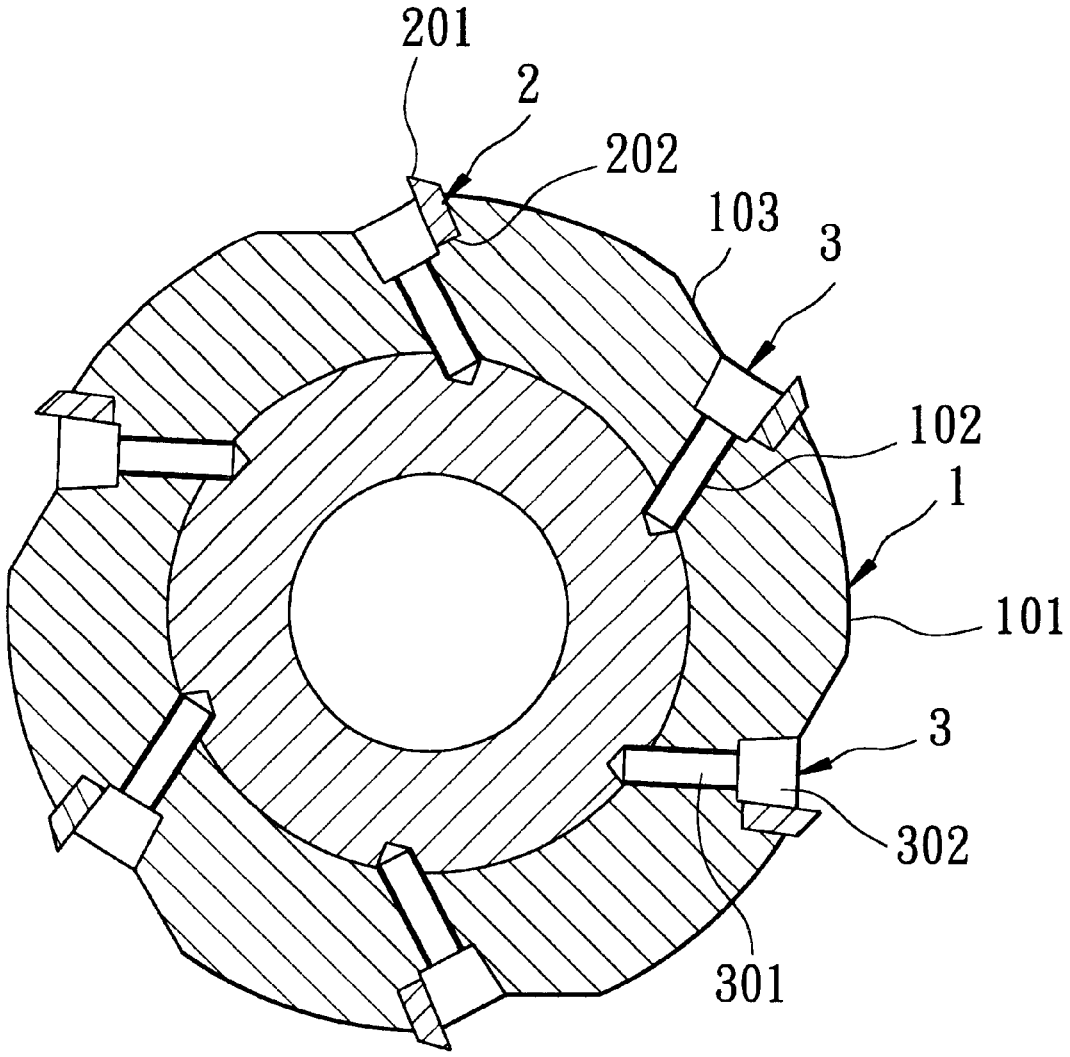
FIG. 2 PRIOR ART
FIG. 2 is an assembled sectional view of the conventional cutting tool device.
Figure 3:
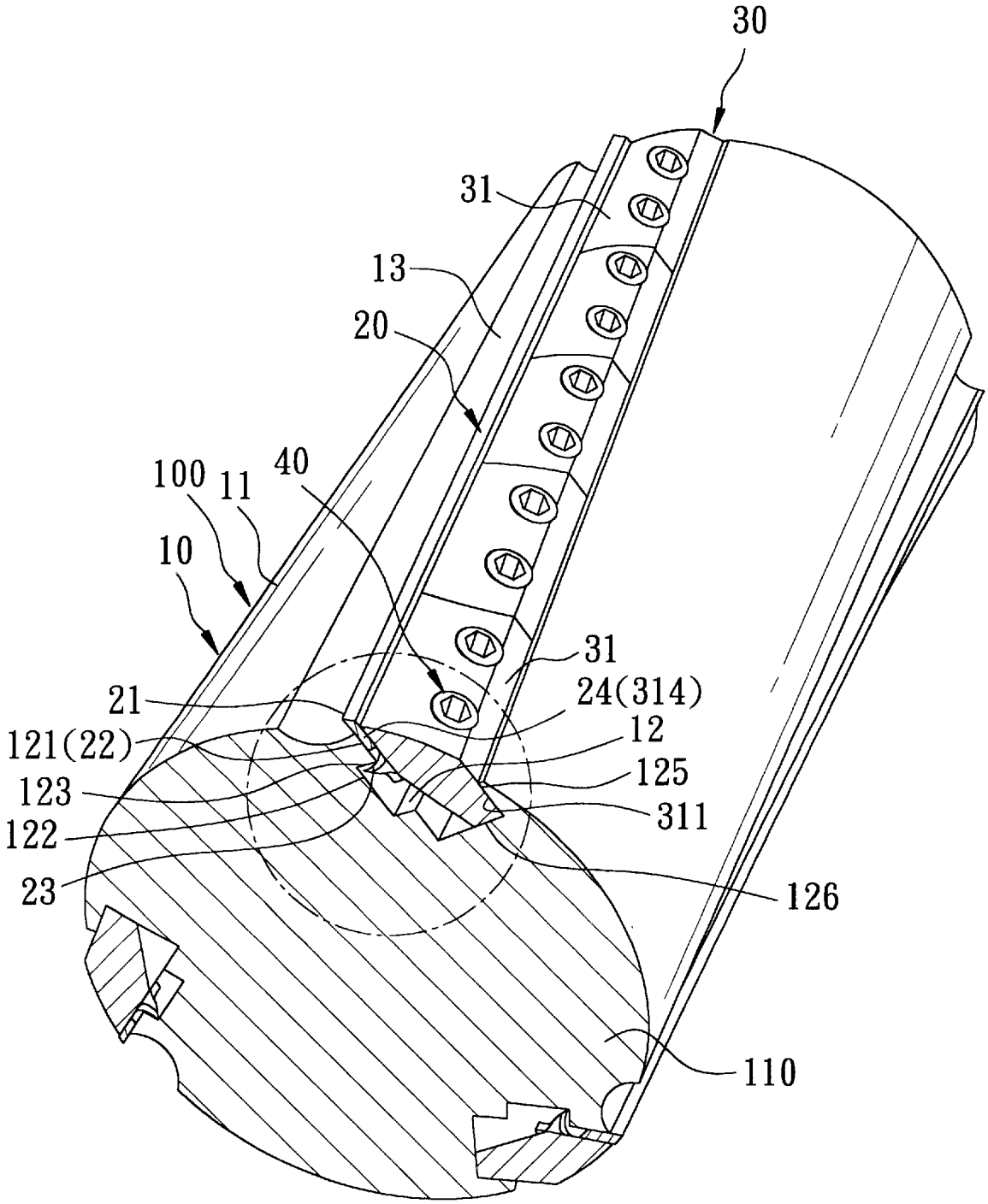
FIG. 3 is a perspective view of a preferred embodiment of a cutting tool device according to the present invention.
Figure 3A:
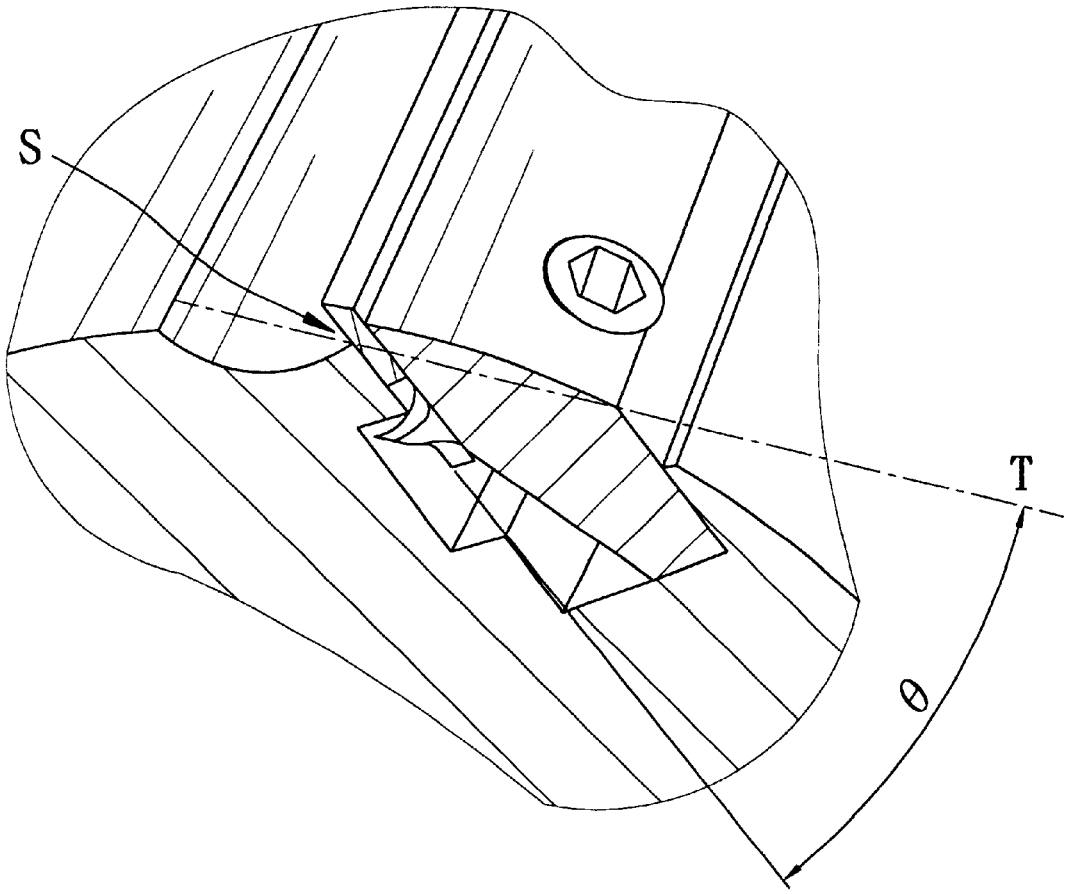
FIG. 3A is an enlarged view of an encircled portion in FIG. 3.
Figure 4:
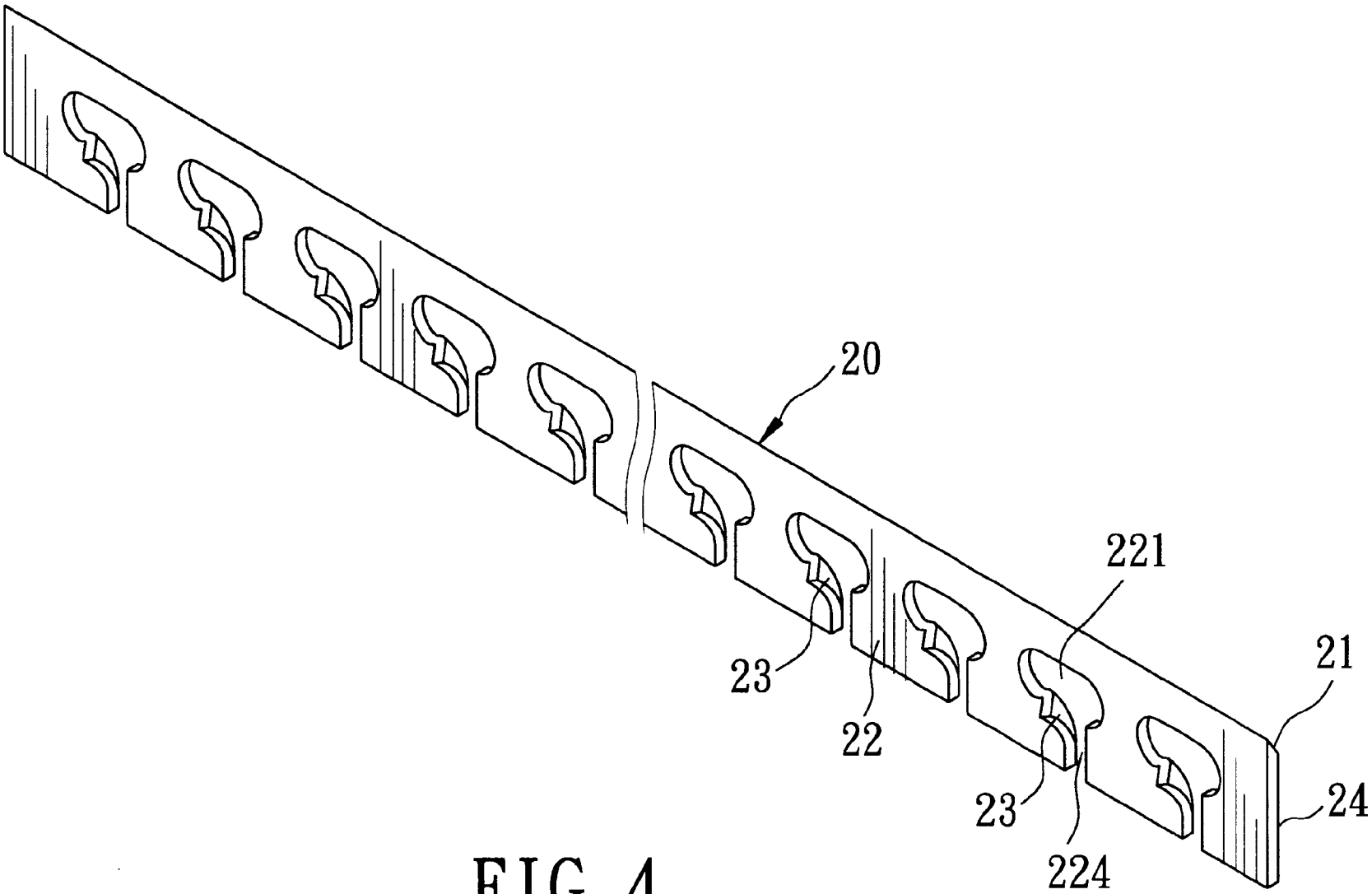
FIG. 4 is a perspective view illustrating a planing knife of the preferred embodiment.
Figure 5:
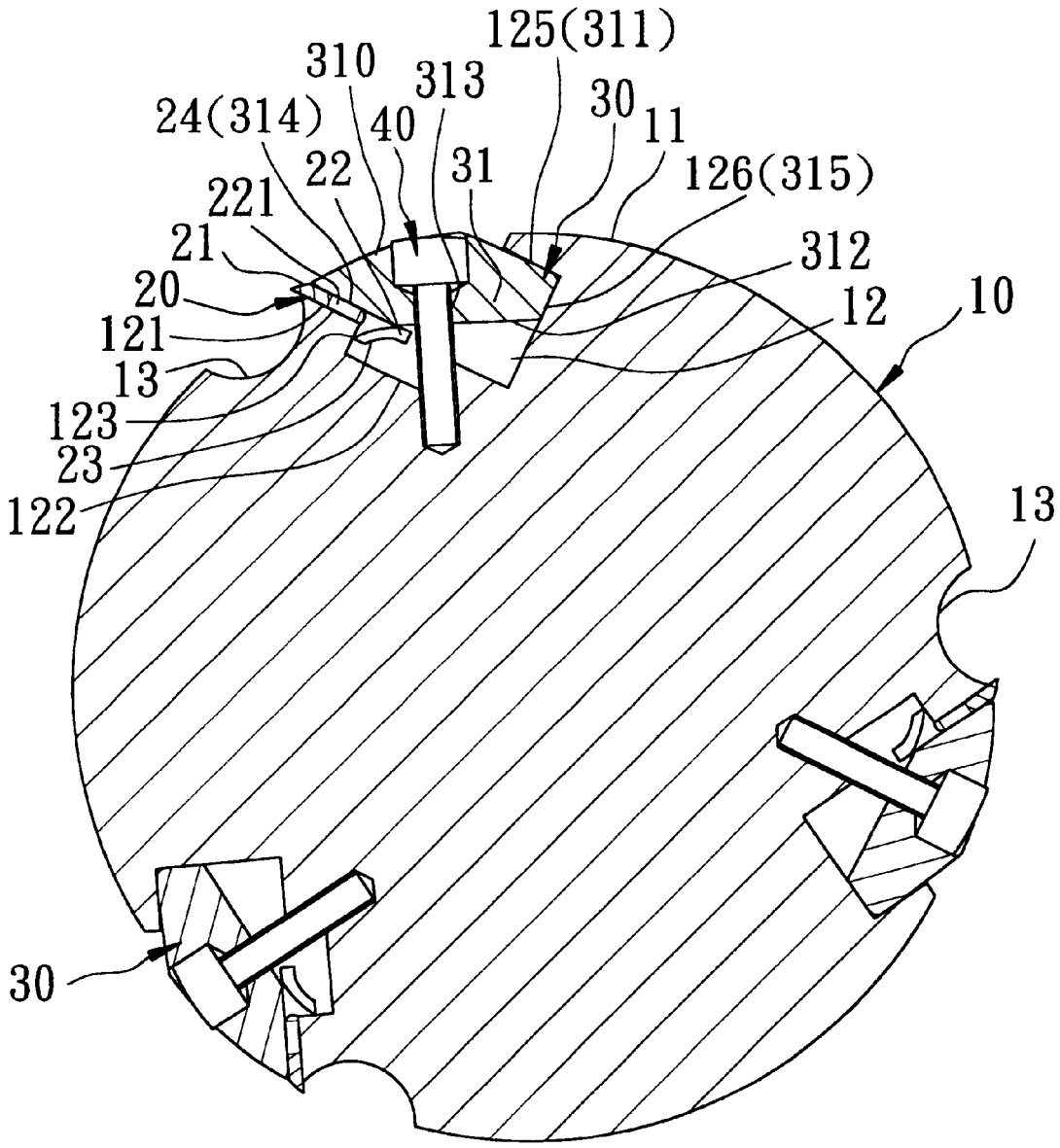
FIG. 5 is an assembled sectional view of the preferred embodiment.

Before the present invention is described in greater detail, it should be noted that like elements are denoted by the same reference numerals throughout the disclosure.

Referring to FIGS. 3, 3A, 4 and 5, the preferred embodiment of a cutting tool device according to the present invention is adapted for use in a wood planing machine (not shown), and is shown to include an elongate knife driving shaft 10, a plurality of planing knives 20, a plurality of tightening insert members 30, and a plurality of tightening members 40.

The knife driving shaft 10 is adapted to rotate in a counterclockwise operating direction about an axis, and includes left and right annular end wall surfaces 110 opposite to each other in an axial direction parallel to the axis, and a cylindrical portion 100 extending therebetween. The cylindrical portion 100 has an outer circumferential wall surface 11 surrounding the axis and a plurality of insert receiving channels 12 disposed to be angularly displaced from one another about the axis. Each of the insert receiving channels 12 includes a knife seat wall surface 121 and an abutment wall surface 125. The knife seat wall surface 121 extends from the outer circumferential wall surface 11 inwards and in the axial direction to form left and right end edges that join and intersect the left and right annular end wall surfaces 110, respectively. The left and right end edges respectively have left and right secant points (S) at a respective junction with the outer circumferential wall surface 11. Each of the left and right end edges is configured such that an acute angle (θ) is formed between a respective one of the left and right end edges and a tangent line (T) which extends from a respective one of the left and right secant points (S) rearwards in terms of the operating direction, and such that the left secant point (S) lags behind the right secant point (S) in the operating direction. The abutment wall surface 125 extends from the outer circumferential wall surface 11 inwards and in the axial direction to form left and right lateral edges that join the left and right annular end wall surfaces 110, respectively. The left and right lateral edges are configured to be spaced apart from the left and right end edges, respectively, so as to confine an accommodating cavity 126 therebetween. The accommodating cavity 126 extends radially and outwardly to communicate with the outer circumferential wall surface 11. Furthermore, the knife seat wall surface 121 has an elongate groove 122 formed therein. The elongate groove 122 extends in the axial direction to communicate the left end edge with the right end edge and away from the abutment wall surface 125 to terminate at a front end wall surface. The front end wall surface and the knife seat wall surface 121 cooperatively form a retaining shoulder surface 123 that extends in the axial direction.

Each of the planing knives 20 includes front and rear major blade surfaces 22, 24 opposite to each other, and an elongate cutting edge 21 which has left and right edge ends opposite to each other and joining the front and rear major blade surfaces 22, 24. Each of the planing knives 20 is disposed in a respective one of the insert receiving channels 12 such that the front major blade surface 22 is disposed to abut against the knife seat wall surface 121, such that the elongate cutting edge 21 is disposed to extend beyond the outer circumferential S wall surface 11, such that the left and right edge ends are disposed to be adjacent to the left and right secant points (S), respectively, and such that the rear major blade surface 24 faces towards the abutment wall surface 125. Furthermore, each of the elongate planing knives 20 includes a plurality of hook members 23 spaced apart from each another in the axial direction and disposed on the front major blade surface 22. The hook members 23 extend away from the rear major blade surface 24, and are formed by punching the respective planing knife 20. In this embodiment, each of the hook members 23 has a generally triangular profile, and is punched from the respective planing knife 20 such that an opening 224 is formed to extend downwardly to a bottom edge of the respective planing knife 20 distal to the cutting edge 21. In addition, each of the planing knives 20 has a plurality of weakening holes 221 disposed therein. The weakening holes 221 are displaced from one another, and extend through the front and rear major blade surfaces 22, 24 so as to enhance bendability of the respective planing knife 20 along the length thereof. In this embodiment, each of the weakening holes 221 is generally oval in shape and is communicated with a corresponding opening 224.

Each of the tightening insert members 30 is disposed to be removably inserted into the respective accommodating cavity 126 to abut against the rear major blade surface 24 of one of the planing knives 20 and the abutment wall surface 125 of one of the insert receiving channels 12, respectively, and has front and rear mating wall surfaces 314, 311 opposite to each other in the operating direction, a top wall surface 310 joining the front and rear mating wall surfaces 314, 311, a lateral side wall surface 315 extending from the rear mating wall surface 311, and a bottom side wall surface 312 joining the lateral side wall surface 315 and the front mating wall surface 314. When a respective one of the tightening insert members 30 is being inserted into the respective accommodating cavity 126 radially and inwardly, a friction force generated as a result of sliding movement of the front mating wall surface 314 along the rear major blade surface 24 will impart a force component to the rear mating wall surface 311 to cause the latter to abut against the abutment wall surface 125, with the lateral side wall surface 315 abutting against a bottom surface of the accommodating cavity 126, thereby clamping the respective one of the elongate planing knives 20 between the front mating wall surface 314 and the knife seat wall surface 121. When the rear mating wall surface 311 abuts against the abutment wall surface 125, the hook members 23 are brought to be disposed beneath and retained on the retaining shoulder surface 123. Furthermore, a plurality of threaded holes 313 are formed to extend from the top wall surface 310 through the bottom wall surface 312 of the respective insert member 30. In this embodiment, each of the tightening insert members 30 includes a plurality of insert units 31 disposed in series along the respective accommodating cavity 126 in the axial direction.

The tightening members 40 are disposed to extend through the threaded holes 313 in the tightening insert members 30 to threadedly secure the tightening insert members 30 to the cylindrical portion 100 so as to ensure immobility of the elongate planing knives 20 thereon.

The cylindrical portion 100 further has a plurality of elongate depressed regions 13. Each of the depressed regions 13 extends in the axial direction and inwardly and radially from the outer circumferential wall surface 11, and is disposed forwardly of and proximate to the knife seat wall surface 121 of a respective one of the insert receiving channels 12 so as to receive wood shavings scraped from a workpiece (not shown) during running of a respective one of the planing knives 20.

During assembly, each of the planing knives 20 is slidably inserted into a respective one of the insert receiving channels 12 along the knife seat wall surface 121 until the hook members 23 thereon are retained by the retaining shoulder surface 123. Then, the insert units 31 of each one of the tightening insert members 30 are fitted in sequence in the respective one of the insert receiving channels 12 such that the front and rear mating surfaces 314, 311 respectively abut against the rear major blade surface 24 and the abutment wall surface 125 to thereby clamp the respective planing knife 20 firmly in the respective accommodating cavity 26. Finally, the tightening members 40 are extended through the threaded holes 313 in the respective tightening insert member 30 to lock the respective planing knife 20 on the knife driving shaft 10.

Figure 6:
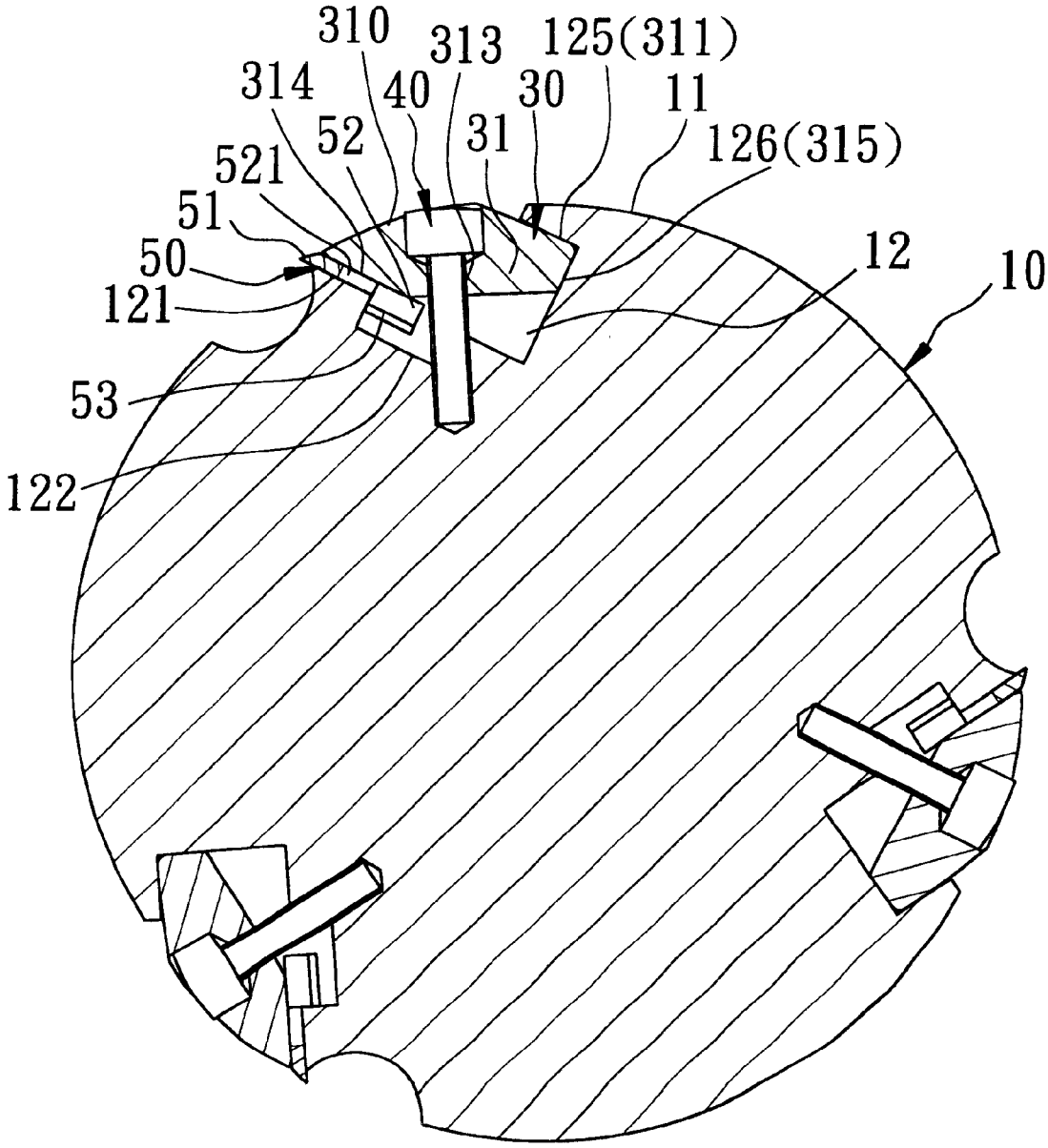
FIG. 6 is an assembled sectional view of another preferred embodiment of a cutting tool device according to the present invention.
Figure 7:
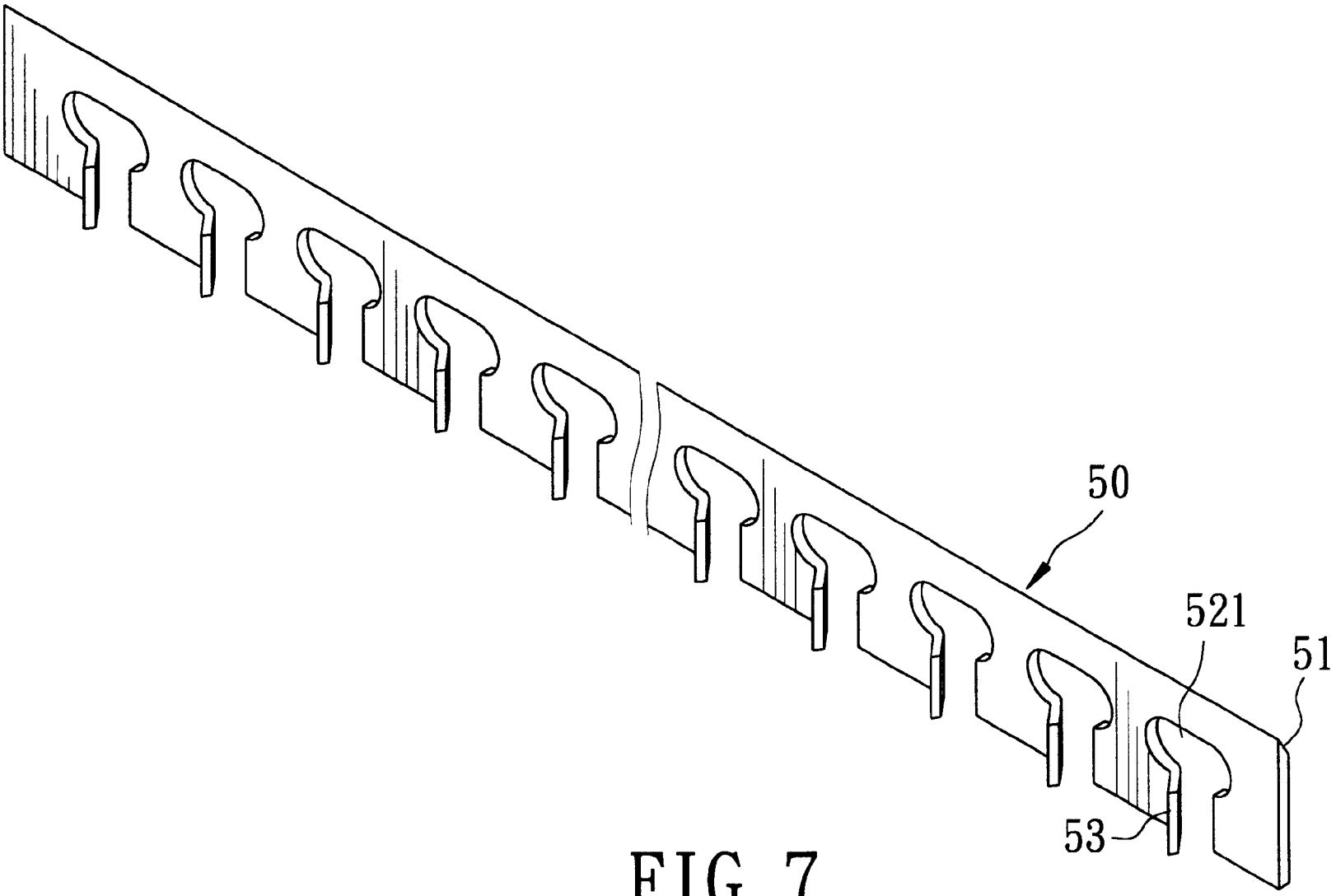
FIG. 7 is a perspective view illustrating a planing knife of the embodiment shown in FIG. 6.

FIGS. 6 and 7 illustrate another preferred embodiment of the cutting tool device of the present invention. This embodiment is substantially the same as the previous embodiment in construction, the main difference residing in that the cutting tool device of this embodiment has a plurality of elongate planing knives 50, each of which has a cutting edge 51, a plurality of weakening holes 521, and a plurality of hook members 53 punched from the respective planing knife 50 and having a generally rectangular profile.

Due to the configuration of the insert receiving channels and the provision of the weakening holes in the planing knives, the planing knives are more flexible and bendable. As a result, during planing of a wooden workpiece, the contact between the planing knives and the workpiece is a point contact which, compared with the linear contact in the prior art, can reduce the load borne by an output shaft of a motor of the wood planing machine, thereby saving power consumption. In addition, the planing knives can be firmly positioned on the knife driving shaft.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A cutting tool device for a wood planing machine, said cutting tool device comprising:

an elongate planing knife driving shaft adapted to rotate in a counterclockwise operating direction about an axis and including left and right annular end wall surfaces opposite to each other in an axial direction parallel to the axis, and a cylindrical portion extending therebetween, said cylindrical portion having an outer circumferential wall surface surrounding the axis and a plurality of insert receiving channels disposed to be angularly displaced from one another about the axis, each of said insert receiving channels including:

a knife seat wall surface extending from said outer circumferential wall surface inwards and in the axial direction to form left and right end edges that join and intersect said left and right annular end wall surfaces respectively, said left and right end edges respectively having left and right secant points at a respective junction with said outer circumferential wall surface, each of said left and right end edges being configured such that an acute angle is formed between a respective one of said left and right end edges and a tangent line extending from a respective one of said left and right secant points rearwards in terms of the operating direction, and such that said left secant point lags behind said right secant point in the operating direction; and an abutment wall surface extending from said outer circumferential wall surface inwards and in the axial direction to form left and right lateral edges that join said left and right annular end wall surfaces respectively, said left and right lateral edges being configured to be spaced apart from said left and right end edges, respectively, so as to confine an accommodating cavity therebetween, said accommodating cavity extending radially and outwardly to communicate with said outer circumferential wall surface;

a plurality of elongate planing knives, each of which includes front and rear major blade surfaces opposite to each other, and an elongate cutting edge which has left and right edge ends opposite to each other and joining said front and rear major blade surfaces, each of said planing knives being disposed in a respective one of said insert receiving channels such that said front major blade surface is disposed to abut against said knife seat wall surface, such that said elongate cutting edge is disposed to extend beyond said outer circumferential wall surface, such that said left and right edge ends are disposed to be adjacent to said left and right secant points, respectively, and such that said rear major blade surface faces towards said abutment wall surface;

a plurality of tightening insert members, each of which has front and rear mating wall surfaces opposite to each other in the operating direction and is disposed to be removably inserted into said accommodating cavity to abut against said rear major blade surface of one of said planing knives and said abutment wall surface of one of said insert receiving channels respectively, said tightening insert members being configured such that when a respective one of said tightening insert members is being inserted into said accommodating cavity radially and inwardly, a friction force generated as a result of sliding movement of said front mating wall surface along said rear major blade surface will impart a force component to said rear mating wall surface to cause said rear mating wall surface to abut against said abutment wall surface, thereby clamping the respective one of said planing knives between said front mating wall surface and said knife seat wall surface; and a plurality of tightening members disposed to threadedly secure said tightening insert members to said cylindrical portion respectively so as to ensure immobility of said planing knives.

2. The cutting tool device according to claim 1, wherein:

said knife seat wall surface has an elongate groove formed therein, said elongate groove extending in the axial direction to communicate said left end edge with said right end edge and away from said abutment wall surface to terminate at a front end wall surface, said front end wall surface and said knife seat wall surface cooperatively forming a retaining shoulder surface that extends in the axial direction; and each of said planing knives includes a plurality of hook members spaced apart from each another in the axial direction and disposed on said front major blade surface, said hook members extending away from said rear major blade surface such that when said rear mating wall surface is caused to abut against said abutment wall surface, said hook members are brought to be disposed beneath and retained on said retaining shoulder surface.

3. The cutting tool device according to claim 2, wherein said hook members are formed by punching the respective one of said planing knives as a one-piece construction.

4. The cutting tool device according to claim 3, wherein each of said planing knives has a plurality of weakening holes disposed therein, said weakening holes being displaced from one another and extending through said front and rear major blade surfaces so as to enhance bendability of said planing knives along the length thereof.

5. The cutting tool device according to claim 1, wherein said cylindrical portion has a plurality of elongate depressed regions, each of which extends in the axial direction and inwardly and radially from said outer circumferential wall surface, and is disposed forwardly of and proximate to said knife seat wall surface of a respective one of said insert receiving channels so as to receive wood shavings scraped from a workpiece during running of a respective one of said planing knives.

6. The cutting tool device according to claim 1, wherein each of said tightening insert members includes a plurality of insert units disposed in series along said accommodating cavity in the axial direction.

* * * * *